United States Patent [19]

Terakawa et al.

[11] Patent Number: 4,829,312

[45] Date of Patent: May 9, 1989

[54] SLOTTED WAVEGUIDE ANTENNA ASSEMBLY

[75] Inventors: Takashige Terakawa, Yokohama; Mutsumi Takahashi, Kawasaki; Noriyuki Akaba, Ohta, all of Japan

[73] Assignee: Tokyo Keiki Co., Ltd., Tokyo, Japan

[21] Appl. No.: 8,148

[22] Filed: Jan. 22, 1987

Related U.S. Application Data

[63] Continuation of Ser. No. 711,840, Mar. 14, 1985, abandoned.

[30] Foreign Application Priority Data

| | | | |
|---|---|---|---|
| Mar. 14, 1984 | [JP] | Japan | 59-35287[U] |
| Mar. 14, 1984 | [JP] | Japan | 59-35288[U] |
| Apr. 9, 1984 | [JP] | Japan | 59-70502[U] |

[51] Int. Cl.[4] ..... H01Q 13/10

[52] U.S. Cl. ..... 343/756; 343/771; 343/785; 343/834

[58] Field of Search ..... 343/771, 785, 786, 872, 343/912, 834, 878, 770, 756

[56] References Cited

U.S. PATENT DOCUMENTS

| | | | |
|---|---|---|---|
| 2,730,717 | 1/1956 | Katchky et al. | 343/771 |
| 3,039,097 | 6/1962 | Strumwasser et al. | 343/771 |
| 3,146,449 | 8/1964 | Serge et al. | 343/771 |
| 3,234,558 | 2/1966 | Borgiotti | 343/771 |
| 3,496,568 | 2/1970 | Palumbo et al. | 343/771 |
| 3,588,754 | 6/1971 | Hafner | 343/785 |
| 4,030,953 | 6/1977 | Rutschow et al. | 343/912 |

FOREIGN PATENT DOCUMENTS

| | | | |
|---|---|---|---|
| 241847 | 7/1960 | Australia | 343/771 |

OTHER PUBLICATIONS

Telco Electronics Mfg. Co., Cat. No. A-55, Sep. 1957, p. 19.

*Primary Examiner*—William L. Sikes
*Assistant Examiner*—Michael C. Wimer
*Attorney, Agent, or Firm*—Cushman, Darby & Cushman

[57] ABSTRACT

The present invention is applied to a slotted waveguide antenna assembly which comprises a slotted waveguide having a plurality of slots, a reflector having an aperture in front of the slotted waveguide and reflecting radiated electromagnetic wave for forming directive beam, and a mounting portion for mounting the antenna assembly onto a place where the antenna assembly is to be installed.

In such an antenna assembly, a fixing member is provided on the reflector at a position spaced from the slotted waveguide. The fixing member extends between the opposite walls of the reflector and fixed thereto. The fixing member has an end which projects outwardly from the wall of the reflector to form the mounting portion. The fixing member is sufficiently thin as compared with the working wavelength.

The slotted waveguide antenna assembly may have a dielectric wave-guiding arrangement.

2 Claims, 7 Drawing Sheets

SLOTTED WAVEGUIDE ANTENNA ASSEMBLY

BACKGROUND OF THE INVENTION

This is a continuation of application Ser. No. 711,840, filed Mar. 14, 1985, which was abandoned upon the filing hereof.

1. Field of the Invention

This invention relates to a microwave antenna assembly suitable as an antenna for marine radars, and more particularly to a slotted waveguide antenna assembly fixed on a mounting portion and for mounting the assembly onto a rotary drive assembly.

2. Prior Art

A slot array antenna assembly comprising a slotted waveguide is already known. This type of antenna assembly is more compact in structure and lighter in weight than a parabolic reflector antenna and therefore it is widely used for marine radars or the like. However, the slotted waveguide can provide a beam directivity only in a plane including an axis of the slotted waveguide (hereinafter referred to as a horizontal plane) and cannot provide a beam directivity in a plane perpendicular to the horizontal plane (hereinafter referred to as a vertical plane). For this reason, the antenna assembly of this type is usually provided with a flared horn to obtain a directive beam in the vertical plane. Such an arrangement has been disclosed in U.S. Pat. No. 2,730,717.

FIG. 14 illustrates a flared horn type antenna assembly.

The antenna assembly of FIG. 14 is so constructed that a slotted waveguide 10 is fitted in a holder member 2 made of metal channel. A flared horn 5 functioning as a reflector is provided at an aperture portion of the holder member 2, and a grating 6 for suppressing vertical polarization and a radome 7 are placed at an aperture of the flared horn 5.

This antenna assembly is placed on a pedestal 50 encasing a rotary drive assembly therein and is rotated by the rotary drive assembly so as to be used as an antenna for a radar. The antenna assembly has a projection or rib 5*a* on a lower wall of the flared horn 5 and the antenna assembly is mounted on the pedestal in such a manner that it is fixed to an antenna support portion 52 of the pedestal 50 by the projection or rib 5*a* in cooperation with a portion of the holder member 2.

This mounting structure, however, has such problems that since the flared horn 5 is formed with the projection 5*a*, the shape of the horn 5 must be complicated and since the weight of the horn is supported by itself, the wall of the horn having the projection must be thick, thereby increasing manufacturing cost and time. This further increases the weight of the horn and increases the load applied to a portion of the pedestal where the antenna assembly is mounted.

The applicant of the present invention has previously proposed a slotted waveguide antenna assembly which comprises a dieletric waveguiding arrangement and a small-sized reflector which is used in place of the flared horn of the conventional antenna assembly for reducing an area of the aperture (U.S. Ser. No. 350,739, now U.S. Pat. No. 4,488,157).

In this slotted waveguide antenna assembly, the applicant has succeeded in suppressing the side lobe and reducing the aperture area of the reflector because of the effect of the dielectric waveguiding arrangement.

As a result, the entire weight of the antenna assembly is reduced and wind pressure is minimized.

However, further reduction in weight is required according to use. In order to meet this requirement, the thickness of the reflector may be reduced and the material of the reflector may be selected from light weight materials. This however, presents another problem in that sufficient strength is not assured for the reflector of the antenna assembly which is used, for example, as a marine radar subjected to severe conditions.

For this reason, it has been a long task to develop an antenna assembly which is of reduced weight but without deteriorating strength.

SUMMARY OF THE INVENTION

The present invention has been made with a view to overcoming the problems involved in the conventional antenna assembly.

Objects of the Invention

It is a first object of the present invention to provide a slotted waveguide antenna assembly which can be formed without making the shape of a reflector (including a horn) complicated or increasing the weight of the reflector, can save the manufacturing time and cost, and can minimize the effect of a load which is applied to a portion of a pedestal where the antenna assembly is mounted.

It is a second object of the present invention to provide a slotted waveguide antenna assembly which is capable of reducing the weight without reduced strength of the reflector.

Constitution of the Invention

The present invention relates to a slotted waveguide antenna assembly which comprises a slotted waveguide having a plurality of slots, a reflector which opens in front of the slotted waveguide for reflecting an electromagnetic wave radiated from the slotted waveguide so as to form a directive beam, and a mounting portion for mounting the antenna assembly onto a pedestal or the like.

In such a slotted waveguide antenna assembly, this invention is characterized by a fixing member which is sufficiently thin as compared with the working wavelength and provided on the reflector at a position spaced from the radiation source in such a manner that it extends between and through the opposite walls of the reflector and is fixed to the respective walls of the reflector. The fixing member has an end which is projected outwardly from the wall of the reflector so as to be used as a mounting portion for mounting the antenna assembly onto the pedestal or the like.

The present invention is also applicable to a slotted waveguide antenna assembly which comprises a slotted waveguide held, at the rear portion thereof, by a holder member, a dielectric waveguiding arrangement formed of a pair of dielectric plate members sufficiently thin as compared with the working wavelength, supported, at the respective base portions thereof, by the holder member and projected, at the respective tip end portions, forwardly of the slotted waveguide so as to define a space therebetween, and a reflector disposed outside of the base portions of the dielectric plate members and held by the holder member for reflecting electromagnetic waves radiated through the base portions of the dielectric plate members.

In such a slotted waveguide antenna assembly, the present invention is characterized, by a fixing member, sufficiently thin as compared with the working wavelength, disposed on the reflector at a position spaced from the slotted waveguide so as to extend between and through the walls of the reflector and is fixed to the respective walls. The fixing member has an end which is projected outwardly through the wall of the reflector so as to form a mounting portion for mounting the antenna assembly onto a pedestal or the like.

Operation of the Invention

Heretofore, it has been generally considered that metal material scatters electromagnetic waves and should not be placed in front of an electromagnetic wave radiation source (such as a slotted waveguide). The inventors of the present invention, however, have experimentally found that the conventional understanding is not always true. More particularly, they experimentally have found that there is hardly any scattering of electromagnetic wave when the member placed in front of the radiation source is sufficiently thin as compared with the wavelength of the working electromagnetic wave and disposed at a position spaced from the radiation source; and that the scattering of the electromagnetic wave, if any, is within such a negligible range that the obtained radiation pattern satisfies the requirement for the radiation pattern for radars in practical use. The present invention has been made on the basis of such findings and according to the invention, a fixing member which is sufficiently thin as compared with the wavelength of the working electromagnetic wave is provided at a position spaced from the radiation source in such a manner that it extends between and through opposite walls of a reflector and is fixed thereto so that the weight of the reflector may be supported by the fixing member. Thus, no loads is applied onto the reflector. Therefore, it is not necessary to form the reflector in a special shape and to make the walls of the reflector thicker, and accordingly, the reflector can be simpler in structure and lighter in weight.

Furthermore, one end of the fixing member is projected outwardly from the reflector to form a mounting portion so that the antenna assembly of the present invention can be mounted, at the mounting portion, onto a rotary drive assembly.

Further, according to the present invention, a projection which is formed on one of the walls of the reflector in the conventional antenna assembly may be omitted so that the walls of the reflector can be formed symmetrically. Therefore, the upper and lower walls may be used in common and the number of parts may be reduced.

In addition, according to the present invention, when it is embodied into a slotted waveguide antenna assembly with a dielectric waveguiding arrangement, sufficient strength can be obtained even if the reflector is made of a light weight material such as a synthetic material. As a result, the present invention may be applied to various forms of antenna assembly as described in connection with the following embodiments and modifications.

PREFERRED EMBODIMENTS

Figure 1:
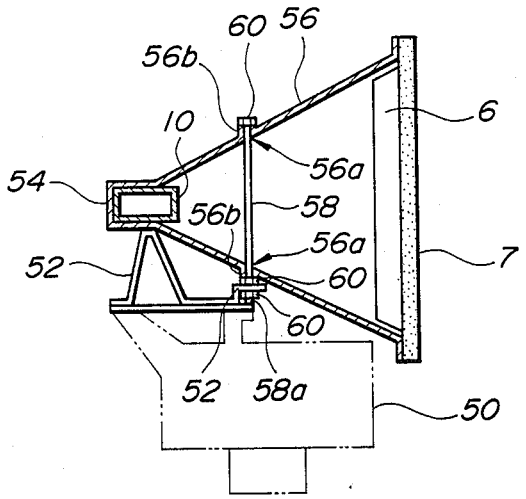
FIG. 1 is a sectional view of one form of a slotted waveguide antenna assembly embodying the present invention.

Preferred embodiments of the present invention will now be described by referring to the drawings.

First Embodiment

A first form of a slotted waveguide antenna assembly according to the present invention as illustrated in FIG. 1 is of a type which is applicable not only to radar but also as a microwave antenna assembly. In the slotted waveguide antenna assembly of this embodiment, a slotted waveguide 10 is fitted in a holder member 54 made of a metal channel, a reflector 56 of a horn type is provided at an opening of the holder member 54, and a grating member 6 for constituting a vertical polarization suppressing element and a radome 7 are provided at an aperture of the reflector 56.

In the antenna assembly of this embodiment, a mounting seat **56*b* with a through hole 56*a* is formed on each of walls of the reflector 56 at a position spaced from the radiation source, namely, the slotted waveguide 10 and a fixing member 58 is fitted in the through holes 56*a* of the mounting seats 56*b* and fixed thereto. The fixing member 58 is made of a rod-like member sufficiently thin as compared with the wavelength of the working electromagnetic wave. The thickness of the fixing member 58 is, for example, less than one eighth of the wavelength and the diameter of the fixing member 58 is about 4 mm in the present embodiment. The material of the fixing member 58 may be selected from metals, synthetic resins, or the like. The fixing member 58** has threads at the opposite ends thereof.

The fixing member 58 is projected, at one end thereof, i.e., a lower end in the embodiment as illustrated, so as to extend through the through-hole 56*a* of the mounting seat 56*b*. The ends of the fixing member 58 are secured to the respective mounting seats 56*b* by nuts 60. The end of the fixing member 58 which is projected outwardly from the reflector 56 forms a mounting portion 58*a* which is fixed to an antenna support portion 52 of a pedestal 50 by a nut 60.

The operation of the first embodiment of the present invention as described above will now be described.

Figure 14:
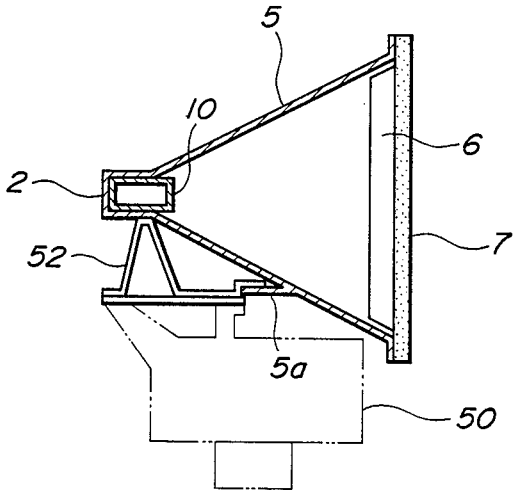
FIG. 14 Prior Art
FIG. 14 is a sectional view of a conventional flared horn type antenna assembly.

While the weight of the reflector is supported only by the lower wall of the reflector in the conventional antenna assembly of FIG. 14, the upper and lower walls of the reflector 56 are supported by the fixing member 58 in the antenna assembly of the present embodiment. With this arrangement, the structure of the mounting seat can be simplified in the present embodiment. Furthermore, since the weight of the forward portion of the antenna assembly is supported by the fixing member 58, the reflector 56 is not needed to be thick enough to support the weight. In addition, since the lower end of the fixing member 58 is used as a mounting portion for mounting the antenna assembly onto the antenna support portion 52 of the pedestal 50, the weight of the reflector is straightly borne by the antenna support portion 52 so that the mounting is dynamically reasonable and no special or additional parts are needed for the mounting.

In the present embodiment, since the fixing member is as thin as one eighth of the wavelength or less, the influence of the scattering of the electromagnetic wave is extremely small and negligible.

Further according to the present embodiment, the walls of the reflector can be formed symmetrically with respect to the axis of the reflector so that the walls can be used in common and the number of parts reduced.

Second Embodiment

Figure 2:
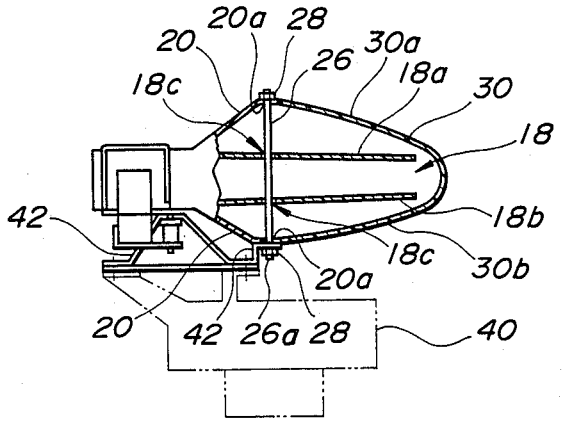
FIG. 2 is a partly cut-away side elevational view of a second form of a slotted waveguide antenna assembly embodying the present invention which is provided with a dielectric waveguiding arrangement.
Figure 3:
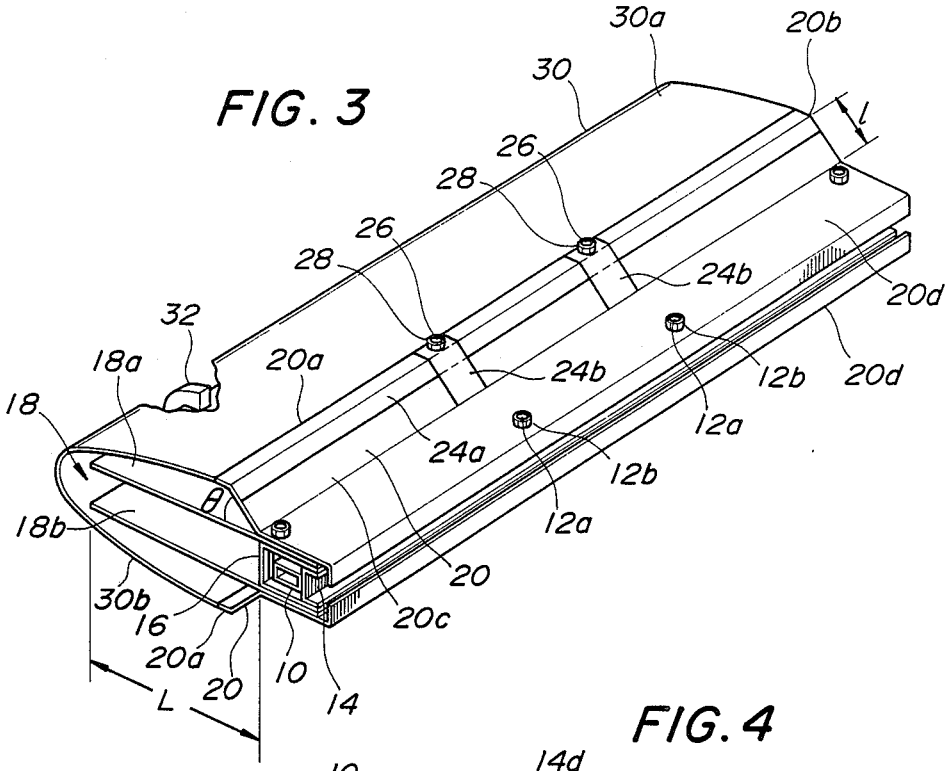
FIG. 3 is a perspective view of an antenna portion of the antenna assembly of FIG. 2.
Figure 4:
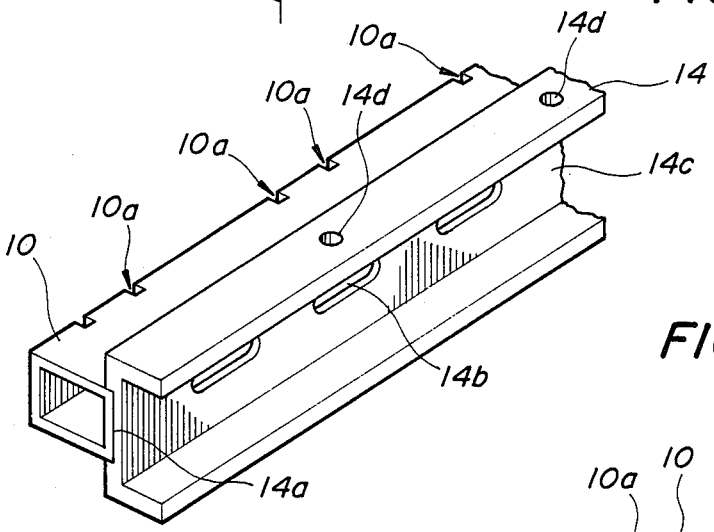
FIG. 4 is a fragmentary perspective view of a holder member and a slotted waveguide in the second form of slotted waveguide antenna assembly shown in FIG. 2.
Figure 5:
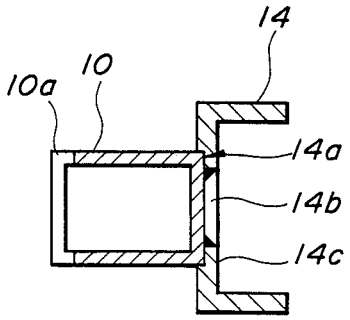
FIG. 5 is a sectional view of FIG. 4.

A second form of a slotted waveguide antenna assembly according to the present invention as illustrated in FIGS. 2 and 3 will now be described. FIG. 2 is partly cut-away side elevational view of the second form of the slotted waveguide antenna assembly and FIG. 3 is a perspective view of an antenna portion of the antenna assembly of FIG. 2.

The slotted waveguide antenna assembly as illustrated in FIGS. 2 and 3 comprises a slotted waveguide 10, a dielectric waveguiding arrangement 18, a reflector 20 and a grid member 16 which are supported by and fixed to a holder member 14. In the present embodiment, a radome 30 is fitted to an aperture of the reflector 20. The reflector 20 and the radome 30 are supported by a fixing member 26 and mounted onto a pedestal 40 by the fixing member 26.

In the embodiment as illustrated, dielectric plate members 18*a*, 18*b* of the dielectric waveguiding arrangement 18 are not in parallel with each other and are closer at the tip end portions thereof. In this connection, it is to be noted that the present embodiment is also applicable to an antenna assembly having dielectric plate members disposed in parallel with each other. When the dielectric plate members 18*a*, 18*b* are not in parallel with each other, the side lobe can be suppressed more than when the dielectric plate members are disposed in parallel with each other.

The holder member 14 is made of a metal channel and has a groove 14*a* extending at a central portion of a web 14*c* along the length thereof. The groove 14*a* has a plurality of holes 14*b* along the length of the groove 14*a*. Although the holes are elongated slots in the embodiment as illustrated, the holes may have any suitable shape, such as circular, square, or the like. The holes 14*b* may alternatively be slits. The holes 14*b* are provided at a position where the slotted waveguide 10 is to be mounted so that the electromagnetic wave may not leak therefrom.

The slotted waveguide 10 has, at a front face thereof, a plurality of slots 10*a* and therefore it is fitted, at the rear portion thereof, into the groove 14*a* and welded to the inner walls of the respective holes 14*b* so as to be fixed to the holder member 14. The fixing of the slotted waveguide 10 to the holder 14 may alternatively be attained by other suitable means such as bonding with adhesives, securing by screws, etc.

The holder member 14 has parallel portions where holes 14*d* are formed. The dielectric plate members 18*a*, 18*b*, the reflector 20 and the grid member 16 are fixed to the holder member 14 through the holes 14*d*.

The dielectric waveguiding arrangement 18 is formed, for example, of dielectric plate members 18*a*, 18*b* made of synthetic resinous materials such as FRP (fiber reinforced plastics). An example of FRP, is epoxy resin bonded glass fiber.

The dielectric waveguiding arrangement 18 is so formed that the dielectric plate members 18*a*, 18*b* are supported, at the base portions thereof, by the holder member 14 and projected, at the tip end portions thereof, forwardly so as to extend, defining a space in front of the slotted waveguide therebetween. In this case, the dielectric plate members 18*a*, 18*b* are disposed in such a manner that the distance between the inner faces of the respective dielectric plate members 18*a*, 18*b* which are opposite to each other through the space and/or the outer faces thereof which are remote from each other differs between the forward end portion of the dielectric waveguiding arrangement and the base end portion thereof. Thus, the dielectric plate members 18*a*, 18*b* are in non-parallel arrangement.

In this embodiment, the dielectric plate members 18*a*, 18*b* are planar plates which are bent slightly at the respective base portions thereof. These plate members are so disposed that the extensions of the respective outer faces may become closer to each other at the tip end portions thereof and the base portions of the plate members are connected to the outsides of the parallel portions of the holder member 14 to constitute the dielectric waveguiding arrangement.

The amount of the bending of the dielectric plate members 18*a*, 18*b* may be varied according to the lengths of the plate members or the length or the aperture angle of the reflector, but the bending is generally made at an angle of as small as 1° to 5°. However, if the parallel portions of the holder member 14 have inclinations, the dielectric plate members need not be bent. Alternatively, the planar dielectric plate members may be bent when they are mounted on the holder member 14.

The inclination angles of the dielectric plate members 18*a*, 18*b* influence the generation of side lobes. According to the experiments conducted by the inventors of the present invention, side lobes are reduced as the angle becomes larger. However, when the angle becomes too large, the radiation pattern of the main lobe deteriorates. For this reason, it is preferred that the inclination angle be within the range as specified above.

The dielectric plate members 18*a*, 18*b* should be sufficiently thin as compared with the working wavelength, for example, one tenth of the working wavelength or less. In the embodiment as illustrated, the thickness t of each of the plate members is 0.078 wavelength. The plate members should be thinner, as the dielectric constant thereof becomes larger. In the present embodiment, the dielectric members have a relative dielectric constant of about 2.8. The reason the thickness t of the plate members should be small is to prevent deterioration of the radiation patern due to the phenomenon that electromagnetic waves are trapped in the dielectric plate members.

It is desirable that the projected lengths L of the dielectric plate members be long, and they, in fact, are preferably several times the wavelength, in view of the converging inclinations of the plate members. In the present embodiment, the length L is 3.4 times the working wavelength.

The side lobe is reduced as the distance between the dielectric plate members 18*a*, 18*b* becomes smaller. However, the distance between the dielectric plate members 18*a*, 18*b* at the base portions thereof should be half the working wavelength or more for mounting the grid member 16.

In the present embodiment, the distance between the faces of the respective dielectric plate members 18*a*, 18*b* which are remote from each other, i.e. the outside faces of the dielectric plate members 18*a*, 18*b* is 0.78 wavelength at the base portions thereof. On the other hand, the distance at the tip end portions of the dielectric plate members is determined by the lengths of the dielectric plate members 18*a*, 18*b* and the inclination angles thereof and it is as long as 0.69 wavelength in the present embodiment.

The reflector 20 is formed of planar plates which are made, for example, of a synthetic resinous material such as FRP which is made for example of epoxy resin bonded glass fiber. The plates are each formed so as to be bent at a given angle $\theta$. This angle $\theta$ is experimentally determined considering the incidence angle of the electromagnetic wave transmitted through the dielectric plate members 18*a*, 18*b* so as to obtain a desired beam pattern of the radiated electromagnetic wave. In the present embodiment, the angle $\theta$ is 25°.

The base portion of the reflector 20 is a mounting portion 20*d* for mounting the reflector 20 onto the holder member 14. The tip end portion of the reflector 20 is a reflecting portion 20*c* for reflecting electromagnetic wave. The reflector 20 further has horizontal projections 20*a* at the aperture 20*b* of the reflector. The radome 30 as will be described in detail later is fitted to the horizontal projections 20*a*, describing a parabola. The mounting portions 20*d* are fixed to the outsides of the parallel portions of the holder member 14 together with the dielectric plate members 18*a*, 18*b* and the grid member 16 by bolts 12*a* and nuts 12*b*.

At the reflecting portion 20*c*, a thin metal plate or sheet 22 is embedded at a position intermediate the surfaces of the reflector 20 to form a reflecting layer 20*e*. The length l of the reflecting portion 20*c* is about twice the working wavelength. In the present embodiment, the length l is 1.56 times of the wavelength.

Figure 6A:
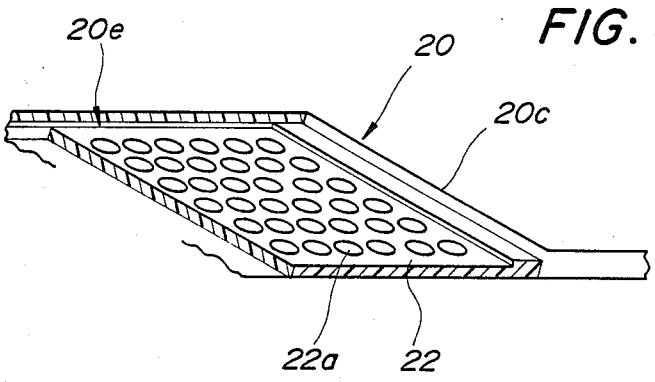
FIG. 6A is a partly cut-away fragmentary view of a reflector employed in the second form of the slotted waveguide antenna assembly of FIG. 2.
Figure 6B:
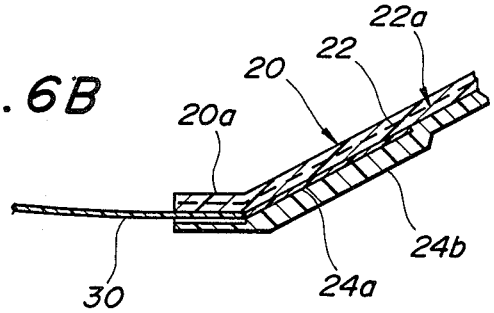
FIG. 6B is a fragmentary sectional view showing the connection of a radome to the reflector in the second form of the slotted waveguide antenna assembly of FIG. 2.

The metal plate or sheet 22 has a plurality of through-holes 22*a* as illustrated in FIGS. 6A and 6B. These through-holes 22*a* reduce the weight of the metal plate or sheet 22 and allow the synthetic resin to penetrate thereinto when the metal plate or sheet 22 is embedded, thereby to bond the synthetic resin layers on the opposite sides of the metal plate or sheet 22 therethrough. Thus, the reflector 20 is reinforced by the metal plate or sheet 22.

The size of each of the through-holes 22*a* is such that the maximum length thereof in the direction perpendicular to the field vector of polarization of the working electromagnetic wave is half the wavelength of said electromagnetic wave or less so as not to transmit the electromagnetic wave to be reflected, therethrough. In the present embodiment, the through-holes 22*a* are circular holes having a diameter of 3 mm for acquiring a sufficient reflection effect. However, the through-holes 22*a* are not limited to the circular holes and they may alternatively be square holes or slits.

Overlays 24*b* are provided on the outside of the reflector 20 at suitable positions in the longitudinal direction thereof so as to extend from the mounting portion 20*d* to the reflecting portion 20*c*. These overlays 24 are also made of FRP. Although two overlays are provided at positions intermediate the longitudinal ends of the reflector in the embodiment as illustrated in FIG. 3, three or more overlays may be provided.

Another overlay 24*b* is provided at a position adjacent to the aperture 20*b* along the length thereof. These overlays 24*a*, 24*b* are bonded to the reflecting portion 20*c* by adhesives.

Figure 6C:
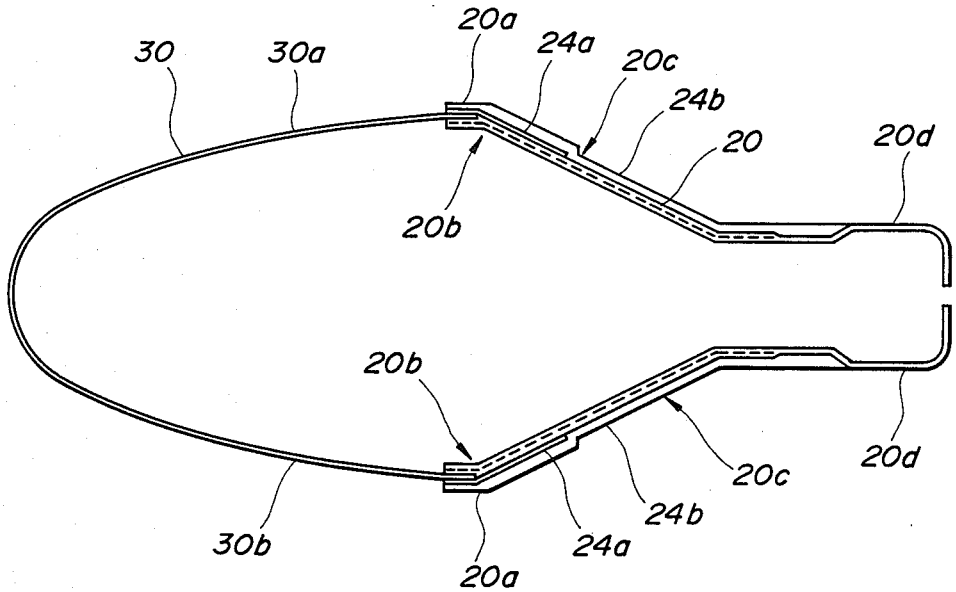
FIG. 6C is a side elevational view of a reflector and a radome which are formed integrally with each other.

To the horizontal projections is fixed a radome 30 as will be described in detail later. The radome 30 is attached to the outsides of the horizontal projections 20*a* as illustrated in FIGS. 6B and 6C and covered by the overlays 24*a*, 24*b* so as to be fixed firmly. Thus, the reflector 20 and the radome 30 are integrally connected at the respective opening portions and they with the mounting portion 20*d*, the reflecting portion 20*c*, the opening portion 20*b*, and the horizontal projection 20*a* to function as a cover.

The front ends of the aperture portions 20*b* of the reflector have horizontal projections 20*a* extending substantially in parallel with the radiation direction of the main lobe. The projections, however, need not in be parallel with the radiation direction of the main lobe so long as impedance matching is aquired and the planar portion of equiphase plane is increased. The projection 20*a* has a length of one fourth of the working wavelength.

The reflector may be made of metal, but if it is made of a synthetic resinous material, the weight of the reflector can be reduced and the load applied to the rotary drive assembly can be reduced.

Figure 7:
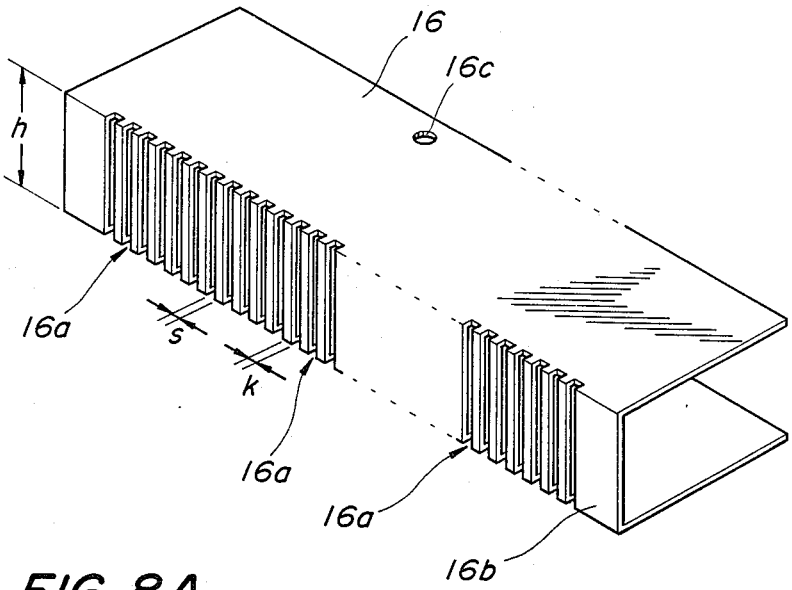
FIG. 7 is a perspective view of one form of a grid member employed in the second form of the slotted waveguide antenna assembly of FIG. 2.

The grid member 16 is made of a metal plate bent into a channel shape. As illustrated in FIG. 7, a number of slits 16*a* extending in the vertical direction are provided at intervals in the longitudinal direction of a web 16*b* of the grid member 16. This grid member 16 is so mounted onto the holder member 14 that the opening portions of the channel are fitted onto the outsides of the parallel portions of the holder and fixed thereto by bolts and nuts applied into the holes 16*c* together with the dielectric plate members 18*a*, 18*b* and the reflector 20.

The slit 16*a* extends through the height of the web 16*b* and the height h is set to be more than half the working wavelength so as not to suppress horizontal polarization components to be radiated. The width s of the slit 16a is set to be smaller than half the wavelength so as to suppress vertical polarization components. The interval k between the slits 16a is also set to be as small as the width s to prevent reflection at this portion. In the embodiment as illustrated, the height h is 25 mm, the width s is 2 mm and the interval k is 2 mm.

The grid member 16 is held between the base portions of the respective dielectric plate members 18a, 18b and fitted so as to cover the front face of the slotted waveguide 10 by the web 16b with slits. The interval between the slits 16a and the front face of the waveguide 10 is about three fourths of the wavelength so as not to suppress the radiation of electromagnetic wave. In the present embodiment, the distance is 24 mm.

The material of the grid 16 is not limited to metal, but the grid 16 may be made of a non-metallic plate, such as a plastic plate formed in a channel shape which is provided with slits 16a and covered with conductive layer.

Although the grid 16 may be omitted, it is preferably provided if it is necessary to suppress the vertical polarization component.

The radome 30 is made of dielectric sheet material such as FRP (fiber reinforced plastic) sheet bent substantially in a U-shape. The aperture portions of the U-shaped material are connected and fixed to the reflector 20.

The radome 30 is so provided that it encloses the dielectric waveguiding arrangement 18, keeping a given space therefrom. Portions 30a, 30b of the radome 30 which extend along the dielectric plate members 18a, 18b function as a second dielectric waveguiding arrangement in the present embodiment. Although the radome 30 is made of the same material as the dielectric plate members 18a, 18b in the present embodiment, it may of course be made of other materials.

The sheet forming the radome 30 is sufficiently thin as compared with the wavelength and it is for example as thin as 0.1 wavelength or less. In the present embodiment, the thickness of the sheet is 0.05 wavelength. The thickness of the radome 30 should be thinner as the dielectric constant becomes larger for the same reason as set forth in connection with the dielectric plate member 18a, 18b.

The radome 30 is formed in a parabola shape in which the portions 30a, 30b extending along the dielectric plate members 18a, 18b are brought closer to each other to form an apex at the tip end portions thereof. The reason the tip end portion of the radome is converged is to suppress side lobes generated at angles largely diverged from the main beam, such as a back lobe. However, the portions 30a, 30b extending along the dielectric plate members 18a, 18b may extend in parallel with each other. In this case, the beam converging effect is not reduced so much.

The radome 30 may be omitted. Hoever, it functions not only as a cover of the antenna aperture but also as a second dielectric waveguiding arrangement. In this respect, it is preferable to provide the radome 30.

Spacers 32 made of materials transparent to the working electromagnetic wave similar to those of a support member as will be described later may preferably be provided at the tip end portions of the dielectric plate members 18a, 18b at appropriate positions in the longitudinal direction of the antenna assembly. In this case, accurate positioning of the dielectric plate members 18a, 18b and the radome 30 is attained.

The fixing members 26 are provided at the horizontal projections 20a of the reflector 20 which are spaced from the front end of the slotted waveguide at the positions thereof where the overlays 24a are provided. Each of the fixing members 26 is sufficiently thin as compared with the wavelength of the working electromagnetic wave. In the present embodiment, the fixing member 26 is a metal rod having a diameter of about 4 mm which is smaller than one eighth of the wavelength. The fixing member 26 is inserted through holes 18c provided on the respective dielectric plate members 18a, 18b and extend between the horizontal projections 20a, 20a so as to be fixed thereto. The fixing member 26 is not limited to a metal rod and it may be made of another material.

The fixing member 26 has threads at the opposite ends thereof and fixed to the horizontal projections 20a by nuts 28. Although two fixing members 26 are used in the present embodiment, three or more fixing members may be used according to the size of the antenna. In this case, the fixing members 26 are disposed at such so as not to suppress the polarization component.

One end (a lower end in the embodiment as illustrated) of the fixing member 26 is projected outwardly from the horizontal projection 20a of the reflector to form the mounting portion 26a which is fixed to the antenna support portion 42 of the pedestal 40 by the nut 28.

The operation of the second embodiment will now be described referring to the drawings.

The operation with respect to the radiated electromagnetic wave will be first described.

In the arrangement as described, an electromagnetic wave is radiated from the slotted waveguide 10, only a horizontal polarization of the electromagnetic wave which has an electric field component in the longitudinal direction of the grid 16 can exist and vertical polarization is suppressed because the height h of each of the slits 16a is more than half of the wavelength and the width s of the slit is much shorter than half of the wavelength.

A component of the electromagnetic wave radiated through the grid 16 which has a small angle with respect to the horizontal plane is reflected by the dielectric plate members 18a, 18b and propagated forwardly. A portion of a component of the electromagnetic wave which has a large angle with respect to the horizontal plane is transmitted through the dielectric plate members 18a, 18b and allowed to propagate as it is. The remaining portion is transmitted through the dielectric plate members 18a, 18b so as to be incident upon the reflector 20 and then reflected by the reflecting layer 20e formed by the metal plate 22 so as to travel forwardly of the antenna. Thus, a portion of the electromagnetic wave radiated at a large angle with respect to the horizontal direction which causes an increase of the side lobe in the conventional antenna assembly can be propagated forwardly in the present embodiment. As a result, the electromagnetic wave energy radiated forwardly is increased, so that a directive beam is obtained and the side lobe is decreased.

In this connection, it is to be noted that when the electromagnetic wave is incident upon the reflector 20, it is not transmitted through the holes 22a because the holes are too small to transmit the electromagnetic wave therethrough.

A portion of the electromagnetic wave radiated from the dielectric plate members 18a, 18b and the reflector 20 is reflected from the radome 30 covering the reflector and is propagated forwardly. Thus, such a component of the electromagnetic wave which travels in the vertical direction of the antenna and spreads the beam is converged to travel forwardly. As a result, the radiation beam is sharpened.

Figure 8A:
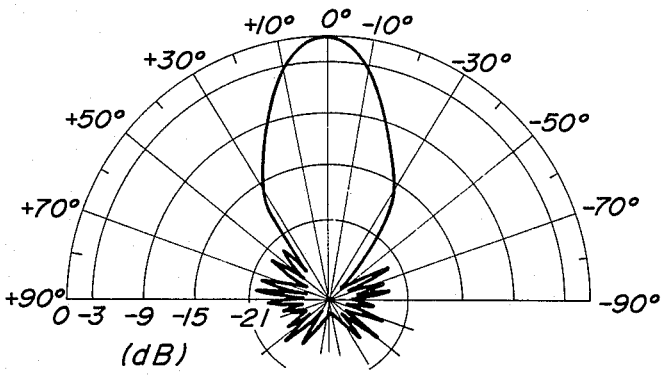
FIG. 8A is a characteristic diagram of an actually measured radiation pattern of the second form of the slotted waveguide antenna assembly of FIG. 2.
Figure 8B:
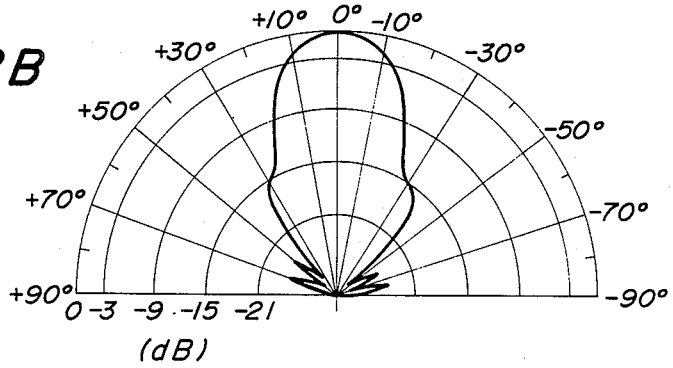
FIG. 8B is a characteristic diagram of an actually measured radiation pattern of the slotted waveguide antenna assembly of FIG. 2 with the radome removed.

An actually measured radiation pattern of the electromagnetic wave radiated from the antenna assembly of the second embodiment is shown in FIG. 8A. FIG. 8B shows another actually measured radiation pattern which is obtained from an antenna assembly having substantially the same structure as that of the second embodiment except that the radome 30 is omitted. In the former, the side lobe level is slightly increased, but the beam half-width, i.e., $-3d$B beam width is 22°, which is much sharpened as compared with 24° in the latter case.

The operation of the mechanism of the present embodiment will be described.

According to the present embodiment, the slotted waveguide 10 is supported and fixed by the metal holder member 14 and constitutes an antenna assembly in cooperation with the reflector and the dielectric waveguiding arrangement 18. In this case, since the slotted waveguide 10 is fixed, at several portions of the rear face thereof, to the holder member 14, it is firmly held by the holder member 14 so as not to be bent when or after it is mounted. Therefore, there is caused no disorder in phase of the radiated electromagnetic wave due to the bending of the slotted waveguide.

Further according to the present embodiment, the holes **14*b*** are formed on the holder member, the heaviest member of the components of the antenna assembly, which reduces the weight of the holder member and allows the assembling of the components to be made in such a manner that they are fixed at a plurality of locations through the holes. This further reduces weight and rotational moment. Therefore, when this antenna assembly is used for a radar, the load to be applied to the rotary drive system for rotating the antenna assembly is reduced.

Since the major portion of the reflector 30 is made of a light synthetic resinous material and the remaining portion is very thin, the total weight of the reflector 20 can be reduced. As a result, the thickness of the holder member 14 for supporting the reflector 20 can also be reduced. For this reason, the weight burdening a mast or the like where the antenna assembly is mounted can also be reduced.

Owing to the construction of the present embodiment wherein the reflector 20, the dielectric plate members **18*a*, 18*b* and the grid 16 are all fixed to the holder by the bolts and nuts 12*a*, 12*b***, the fabrication of the antenna assembly is made very easy.

Further according to the present embodiment, since the upper and lower walls of the reflector 20 are supported by the fixing member 26, it is not needed that the wall or walls of the reflector 20 are made thick. Furthermore, since the lower end of the fixing member 26 is used as the mounting portion **26*a* for mounting the antenna assembly onto the antenna support portion 42, allowing the weight of the reflector 20 to be supported by the antenna support portion 42, the mounting of the antenna assembly is made without strain and without using special mounting members. In addition, the aperture 20*b* of the reflector 20** is accurately positioned, and the angle of the aperture of the reflector can be finely adjusted by slightly deforming the reflector of synthetic material.

Third Embodiment

Figure 9:
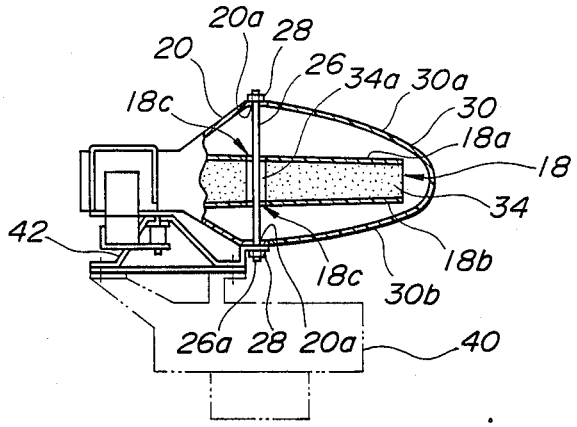
FIG. 9 is a partly cut-away side elevational view of a third form of a slotted waveguide antenna assembly embodying the present invention.
Figure 10:
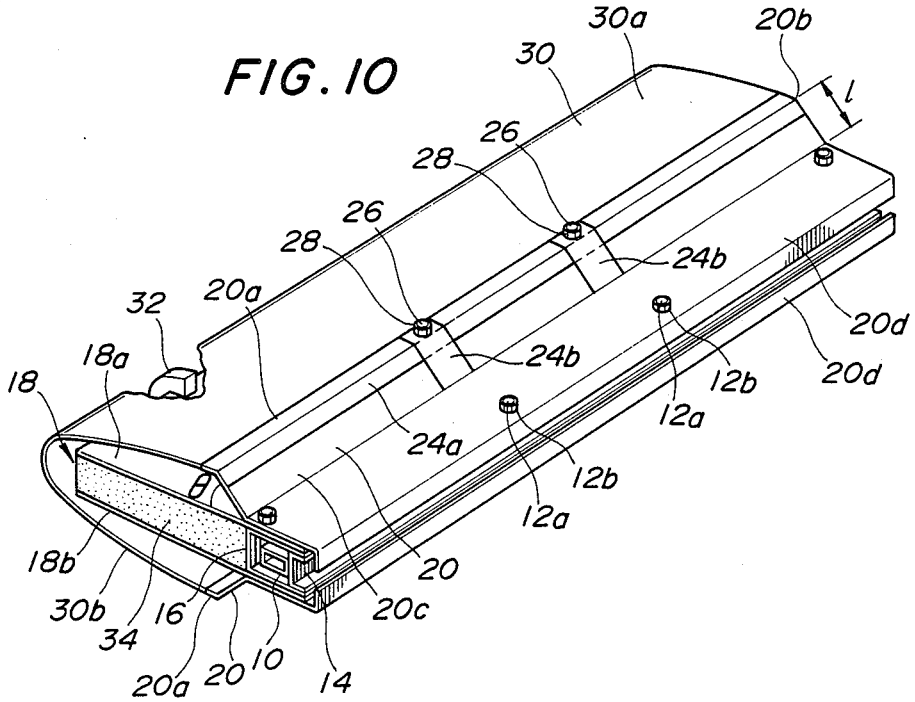
FIG. 10 is a perspective view of an antenna portion of the slotted antenna assemly of FIG. 9.

A third form of a slotted waveguide antenna assembly according to the present invention as illustrated in FIGS. 9 and 10 comprises a support member 34 which is inserted between dielectric plate members **18*a*, 18*b* which are identical with those of the second embodiment. The other structure of the present embodiment than the support member 34** is substantially the same as that of the second embodiment. Therefore, the same or similar parts or portions are denoted by the same or similar numerals or characters and the explanation thereof is omitted here.

The support member 34 is made of a material transparent to electromagnetic wave, i.e., a dielectric material having a relative dielectric factor of substantially 1. The support member 34 is preferably made, for example, of expandable polystyrene. Although the material of the support member 34 is not limited to foamed material, the foamed material has such an advantage that it is light in specific gravity and weight and does not substantially increase the weight of the antenna assembly when it is fitted to the antenna assembly. The foamed material has another advantage in that the specific gravity and the extent of foaming may be selected so as to obtain a desired relative dielectric factor. Thus, desired characteristics can be obtained.

The support member 34 of foamed material is provided in such a manner that the support member which is preliminarily expanded in a mold so as to be formed in a desired shape is inserted between the dielectric plate members **18*a*, 18*b* and bonded thereto by adhesives. Alternatively, foamable material is charged and allowed to expand between the dielectric plate members 18*a*, 18*b* which is held in position by some suitable mold. In the former case, holes 34*a* through which the fixing member 26 is to be inserted are preliminarily formed on the support member 34. The actual size of the hole 34*a*** may be smaller than that as illustrated. In the latter case, there is no need to specially form such holes.

Spacers 32 made of a material similar to that of the support member 34 are preferably provided at the tip end of the dielectric plate members **18*a*, 18*b* at appropriate positions in the longitudinal direction of the antenna assembly. In this case, the positioning of the dielectric plate members 18*a*, 18*b* and the radome 30** is effected accurately.

The support member 34 preferably has a dense skin layer at a surface upon which the electromagnetic wave is incident, namely, the face confronting a grid 16. This can prevent scattering of the incident electromagnetic wave and crumbling of the end of the support member 34.

The operation of the third embodiment will now be described.

The third embodiment operates in substantially the same manner as the second embodiment except for the support member. Therefore, only the operation related to the support member is explained here.

An electromagnetic wave radiated from the slotted waveguide 10 and passed through the grid 16 is incident upon the support member 34. Since the support member 34 has a relative dielectric factor of substantially 1, it is transparent to the electromagnetic wave and does not hinder the propagation of the electromagnetic wave. In case the skin layer is formed on the end face of the support member 34, scattering of the incident electromagnetic wave is avoided.

Since the dielectric plate members 18*a*, 18*b* are supported by the support member 34, bending or fluctuation of the dielectric plate members 18*a*, 18*b* for example by rolling due to wind or wave is prevented. Thus, fluctuation of the side lobe due to the shaking of the dielectric plate members 18*a*, 18*b* can be prevented.

Fourth Embodiment

Figure 11:
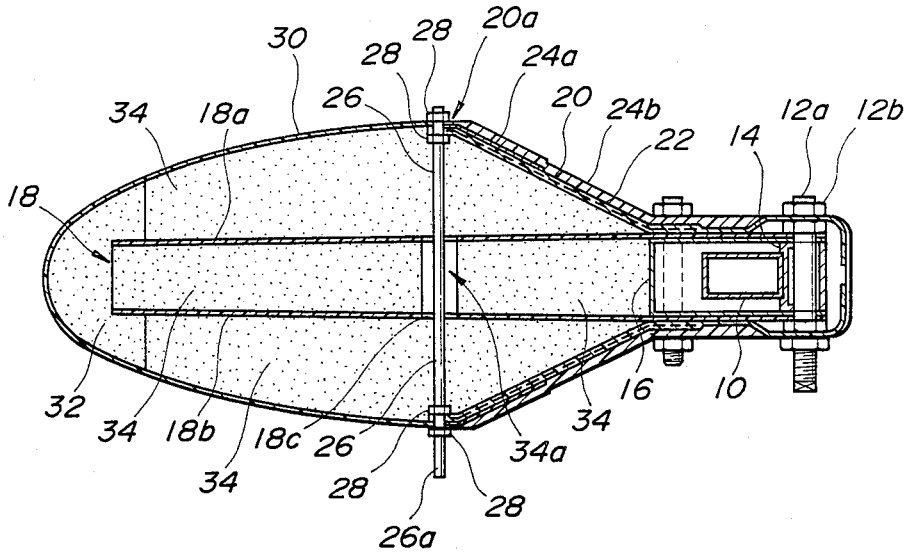
FIG. 11 is a sectional view of a fourth form of a slotted waveguide antenna assembly embodying the present invention.

A fourth embodiment of a slotted waveguide antenna assembly according to the present invention as illustrated in FIG. 11 has a support member 34 which is disposed between the dielectric plate members 18*a*, 18*b* and the radome 30. Other structure of the antenna assembly than the support member 34 is substantially the same as that of the third embodiment. Therefore, same or similar parts or portions are denoted by same or similar numerals or characters and the explanation thereof is omitted here.

In the present embodiment, the support member 34 is made of a foamable material. For providing the support member 34 in the antenna assembly, for example, the foamable material is preliminarily formed in a desired shape and it is fitted between the dielectric plate members 18*a*, 18*b* and bonded to the plate members 18*a*, 18*b* by adhesives. Or, the foamable material is charged and allowed to expand between the dielectric plate members 18*a*, 18*b* and the radome 30.

In this case, spacers 32 are preferably provided at the tip end portions of the dielectric plate members 18*a*, 18*b* at appropriate positions in the longitudinal direction of the antenna assembly to accurately position the dielectric plate members 18*a*, 18*b* and the radome 30. By the spacers 32, undesirable displacement of the radome 30 due to the expansion pressure can advantageously be prevented.

The operation of the fourth embodiment will now be described.

In such an arrangement as described above, when an electromagnetic wave is radiated from the slotted waveguide 10, the electromagnetic wave from which undesired polarization component is eliminated by the grid 16 is incident upon the support member 34 disposed between the dielectric plate members 18*a*, 18*b* and between the dielectric plate members 18*a*, 18*b* and the radome 30. Since the support member 34 has a relative dielectric factor of substantially 1, it is transparent to the electromagnetic wave and does not prevent the propagation of the electromagnetic wave.

The operation of the other structure of the embodiment is similar to those of the foregoing embodiments.

Modifications of the Vertical Polarization Suppressing Elements

Figure 12:
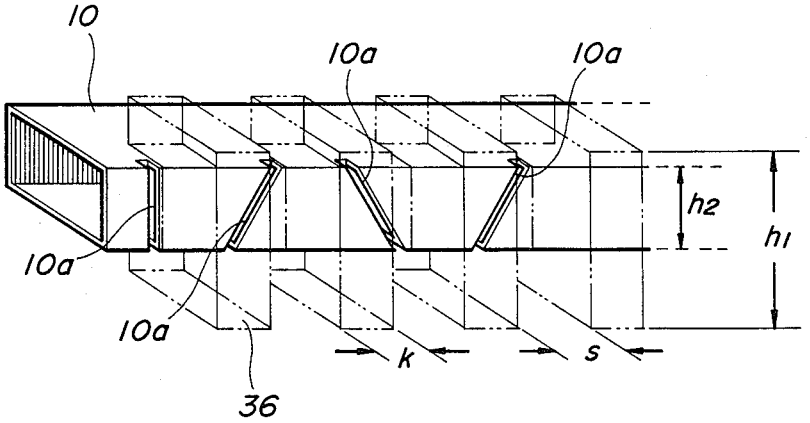
FIG. 12 is a fragmentary perspective view of an element block fitted to the slotted waveguide as a vertical polarization suppressing element.

Although the grid is used as a vertical polarization suppressing element in the foregoing embodiments, a grating may alternatively be employed. Or, a block element may be employed. FIG. 12 illustrates a block type vertical polarization suppressing element fitted to the slotted waveguide 10.

In FIG. 12, each of the element blocks 36 is a metal block having a channel shape in section and disposed between each two adjacent slots 10*a* formed on the slotted waveguide 10.

The height h1 of the element block 36 is equal to the distance between the dielectric plate members 18*a*, 18*b*. The height h2 between the inner upper and lower walls of the block 36 is substantially the same as the height of the slotted waveguide 10. The width k of the block 36 is smaller than the minimum interval of the slots 10*a*.

In order to mount the element block 36 onto the slotted waveguide 10, the block 36 is fitted around the slotted waveguide 10 from the front face thereof at a position between the slots 10*a*. The interval s between the blocks 36 is smaller than 0.5 wavelength.

Figure 13:
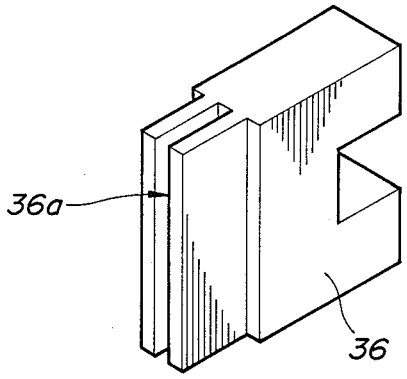
FIG. 13 is a perspective view of another form of the element block.

FIG. 13 illustrates another form of element block.

The element block 36 shown in FIG. 13 is made of metal and has a groove 36*a* on the front face thereof. Other structure is substantially the same as that shown in FIG. 12.

The groove 36*a* acts as a choke for cancelling a surface current produced on the block 36 and preventing stray connection of the adjacent slots of the slotted waveguide.

Although the element block 36 is made of metal in the embodiments of FIGS. 12 and 13, it suffices that the faces of the blocks 36 which confront each other are conductive. Therefore, the block body may be made of metallized plastics.

Modifications of the Embodiments

First, although the holder member 14 and the reflector 20 are separate members in the foregoing embodiments, they may be formed integrally with each other.

Second, although the reflecting layer is formed by a metal plate having a pulurality of holes in the foregoing embodiments, it may be formed of metal net embedded in synthetic resinous materials. Or, a conductive layer may be formed on the surface of the reflector so as to act as a reflecting layer. Of course, the reflecting layer may alternatively be made of continuous layer.

Third, although the reflector is planar in the foregoing embodiments, it may have a curved surface such as a parabolic surface.

Fourth, although the dielectric plate members 18*a*, 18*b* are not disposed in parallel with each other and they are closer at the tip end portions thereof in the foregoing embodiments, they may be arranged in parallel with each other. Even if they are arranged in parallel with each other, the side lobe can be reduced as compared with that when no dielectric waveguiding arrangement is provided. However, when the dielectric plate members 18*a*, 18*b* are not disposed in parallel with each other, the side lobe can be further reduced.

The present invention is not limited to the embodiments or modifications thereof as described above and the elements of the respective embodiments or modifications may be replaced with each other or may be omitted and still be within the spirit of the present invention.

We claim:

1. A slotted waveguide antenna assembly having a working wavelength in the microwave region including:

a slotted waveguide for emitting a directive beam of microwaves;

a holder member for supporting and fixing a rear portion of said slotted waveguide;

a dielectric waveguiding arrangement formed of a pair of dielectric plate members, said dielectric plate members each being formed of a parallel planar plate and each having base and tip end portions, and each having a thickness which is one tenth or less of the working wavelength of said slotted waveguide antenna assembly, said dielectric plate members being supported at the base portions thereof by the holder member and disposed so that they are closer at the tip end portions thereof and being projected at the tip end portions thereof opposite said holder member, forwardly of the slotted waveguide, and arranged so as to define a space between them;

a reflector, having two opposite walls, said reflector being provided outside of the dielectric plate members and supported by the holder member for reflecting microwaves emitted through the base portions of the respective dielectric plate members to form a radiated beam; and at least one fixing member having a thickness which is less than the working wavelength of the slotted waveguide antenna assembly provided at a position or positions spaced from the slotted waveguide, and disposed to extend between the opposite walls of the reflector connected thereto, said at least one fixing member having an end which extends outwardly from a wall of the reflector to form a mounting portion for mounting the slotted waveguide antenna assembly onto a place where the slotted waveguide antenna assembly is to be installed.

2. A slotted waveguide antenna assembly according to claim 1 further comprising an element for suppressing vertical polarization between the dielectric plate members.

* * * * *